US006663098B2

(12) United States Patent
Teo et al.

(10) Patent No.: US 6,663,098 B2
(45) Date of Patent: Dec. 16, 2003

(54) COMPOUND KICKER IN MEDIA HANDLING SYSTEM

(75) Inventors: Cherng Linn Teo, Singapore (SG); Tzy Woei Chu, Singapore (SG); Keng San Chia, Singapore (SG); Chuah Fatt Ng, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/133,760

(22) Filed: Apr. 25, 2002

(65) Prior Publication Data

US 2003/0201596 A1 Oct. 30, 2003

(51) Int. Cl.[7] ..... B65H 3/52
(52) U.S. Cl. ..... 271/121; 271/119
(58) Field of Search ..... 271/121, 119

(56) References Cited

U.S. PATENT DOCUMENTS 5,764,384 A * 6/1998 Wilcox et al. ..... 358/498
6,082,729 A * 7/2000 Padget ..... 271/121
6,086,062 A * 7/2000 Nakamura et al. ..... 271/121

* cited by examiner

*Primary Examiner*—Donald P. Walsh
*Assistant Examiner*—Matthew J. Kohner

(57) ABSTRACT

A kicker in a printing device is mounted adjacent to an entrance of a feed zone where a pick roller is located for picking a top sheet from an input tray in a pick process. A plurality of next-to-top sheets next to the top sheet move out of the input tray and stop approximately at the entrance of the feed zone during the pick process. The kicker includes a relatively rigid base part for kicking a first portion of the next-to-top sheets back to the input tray and a flexible top part attached to the base part for kicking a second portion of the next-to-top sheets back to the input tray.

7 Claims, 9 Drawing Sheets

COMPOUND KICKER IN MEDIA HANDLING SYSTEM

BACKGROUND

This invention relates generally to printing devices, and more particularly to techniques for handling media sheets during a pick process.

In a printing device, for example a printer partially shown in FIG. 1, a pick roller 101 picks a top sheet 111 atop a stack of media 109 accommodated in an input tray 107 of the printer. In addition, the pick roller 101 advances the top sheet 111 along a media path through a feed zone 113 in the printer for subsequently imprinting images on it. Due to the friction force between adjacent media sheets, several sheets next to the top sheet (hereinafter "next-to-top sheets," not shown in FIG. 1) also leave the input tray 107 and follow the top sheet 111 into the feed zone 113. To avoid such a multiple pick, where several sheets are picked and advanced through the feed zone, a separator 105 is mounted in the media path at the entrance 115 of the feed zone 113 approximately opposite the pick roller 101 for stopping further movement of at least part of the next-to-top sheets. Movements of the remaining part of the next-to-top sheets can be stopped by either the separator or printer structures located in the media path and before the separator in a media advancement direction.

To avoid affecting subsequent picks of sheets from the input tray during a printing operation, these next-to-top sheets that have moved out of the input tray 107 and stopped somewhere in the feed zone are supposed to be cleared from the feed zone before the next pick process starts. A conventional kicker 103, which is mounted on the media path adjacent to an edge of the input tray and before the separator 105 in the media advancement direction, is commonly used to kick the next-to-top sheets back to the input tray 107. Normally, such a conventional kicker 103 is made of rigid materials.

Additionally, the kicker is biased in a kicking position by a biasing spring (not shown) before a pick process starts. When the pick process starts, the kicker 103 is activated to move from the kicking position to an activated or feed position, in which the kicker 103 does not disturb the movements of the top sheet 111 or the next-to-top sheets. During the pick process, the kicker 103 will be kept in the feed position by the pick roller 101 or a kicker cam (not shown in FIG. 1) for a period until the leading edge of the top sheet has been fed into the feed zone 113 for a predetermined distance. Then the kicker 103 is released and moves back to the kicking position due to the biasing force to kick the next-to-top sheets back to the input tray 109, which sheets have moved out of the input tray 109 and have stopped somewhere in the feed zone.

Note that in some designs as shown by FIG. 1, the conventional kicker 103 moves back to the kicking position when the trailing edge of the top sheet 111 has not yet passed the feed zone entrance 115 or the kicker 113. The objective of this design is to try to kick the next-to-top sheets in the current pick process back to the input tray as soon as they are separated so as to avoid sheet-to-sheet dragging that could cause multiple pick. In that case, as shown in FIG. 1, the kicker 103 may interfere with the top sheet 111 being advanced through the feed zone 113 when the kicker 103 moves toward the kicking position. Such interference may increase the amount of stress on the top sheet 111 and therefore may degrade the printing performance. This is because the stress on the top sheet exists until the trailing edge leaves the kicker and may affect the linefeed of the top sheet and consequently the image quality of the top part of the printout. Additionally, the stress from the kicker is applied only at certain areas on the top sheet 111 where the interference occurs and is not uniformly distributed across the media width of the top sheet 111. Thus, if the amount of stress is increased to a certain extent, the stress may cause the top sheet 111 to skew and affect its linefeed accuracy. As a result, the printing performance can be adversely affected.

There are ways of reducing the stress on the top sheet 111 caused by the interference between the kicker 103 and the top sheet 111. For example, a kicker with a reduced length can be used to reduce the interference because normally a longer kicker will generate more interference. However, in most cases, the user may want the kicker to be as long as possible so as to cover a longer sweeping area. Reducing the length of the kicker may decrease its effectiveness.

Alternatively, the stress on the top sheet 111 can be reduced by reducing the biasing force applied to the kicker 103, for example, by using a biasing spring with a lower stiffness, so as to reduce the kicking force exerted by the kicker 103. However, reducing the kicking force may cause a less effective kick of the next-to-top sheets by the kicker 103, especially if there is a heavy stack of next-to-top sheets.

Therefore, there is a need for an improved kicking mechanism in a printing device that effectively moves the next-to-top sheets back to the input tray with less interference between the kicking mechanism and the top sheet.

SUMMARY

According to the present invention, a kicker in a printing device is mounted adjacent an entrance of a feed zone where a pick roller is located for picking a top sheet from an input tray in a pick process. A plurality of next-to-top sheets next to the top sheet move out of the input tray and stop approximately at the entrance of the feed zone during the pick process. The kicker includes a relatively rigid base part for kicking a first portion of the next-to-top sheets back to the input tray and a flexible top part attached to the base part for kicking a second portion of the next-to-top sheets back to the input tray.

According to a second aspect of the invention, a media handling system in a printing device includes a pick roller for picking a top sheet from an input tray toward a print zone during a pick process and a kicker mounted adjacent the pick roller. A plurality of next-to-top sheets next to the top sheet are drawn out of the input tray and stop approximately at an entrance of the print zone during the pick process. Furthermore, the kicker includes a relatively rigid base part for kicking a first portion of the next-to-top sheets back to the input tray and a flexible top part attached to the base part for kicking a second portion of the next-to-top sheets back to the input tray.

According to a further aspect of the invention, a method is provided for kicking a plurality of next-to-top sheets back to an input tray in a printing device. The next-to-top sheets move out of the input tray and stop approximately at an entrance of a feed zone during a pick process. The method includes the steps of:

providing a kicker having a relatively rigid base part and a flexible top part attached to the base part;

kicking a first portion of the next-to-top sheets back to the input tray by using the base part of the kicker; and kicking a second portion of the next-to-top sheets back to the input tray by using the top part of the kicker.

Other aspects and advantages of the invention will become apparent from the following detailed description taken in conjunction with the accompanying drawings, which illustrates by way of example the principles of the invention.

DETAILED DESCRIPTION

Figure 2:
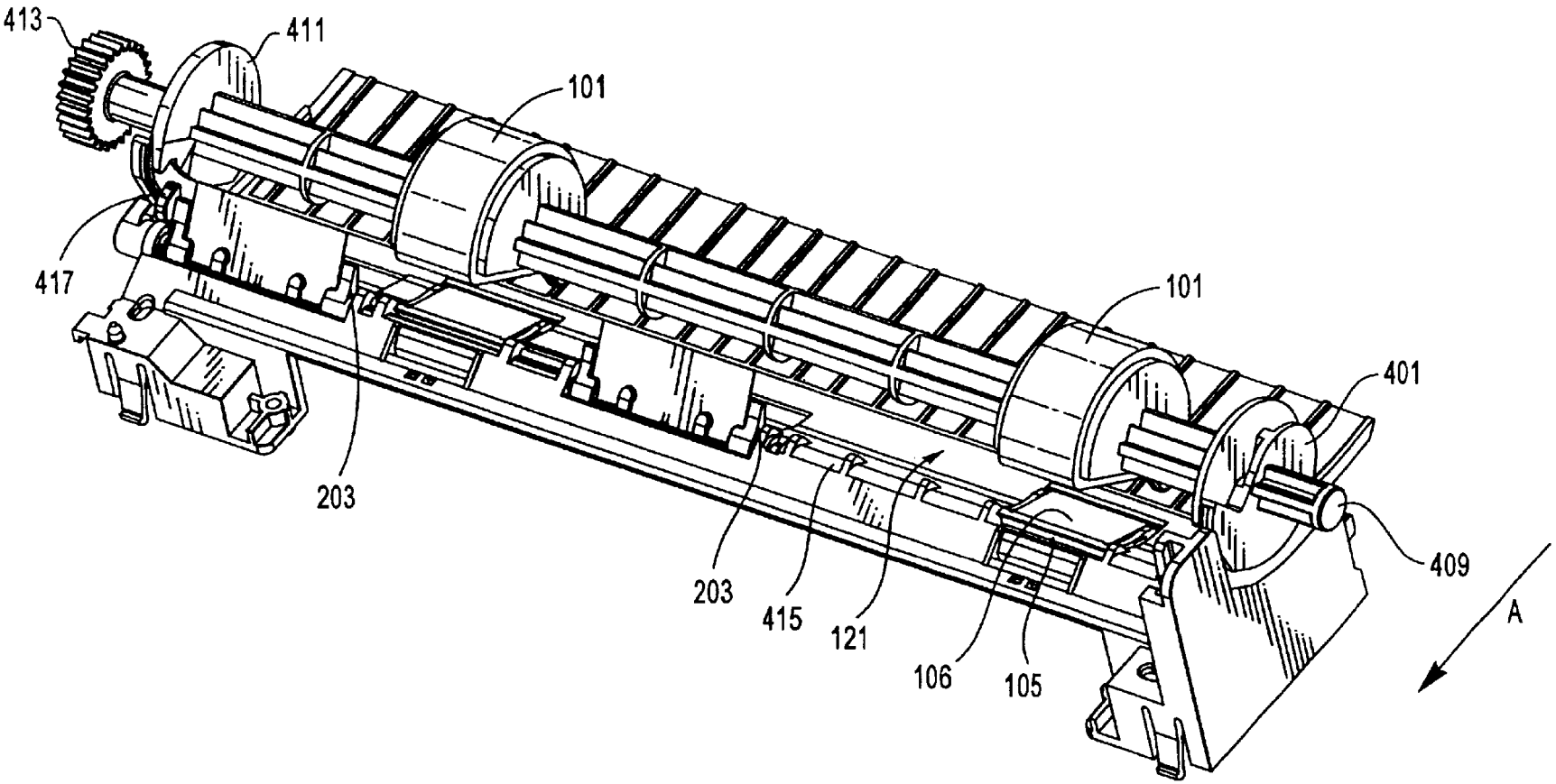
FIG. 2 is a perspective view of a media handling system in which an exemplary embodiment of the present invention can be used.

FIG. 2 illustrates an L-path media picking mechanism that is commonly used in inkjet printers. Although an exemplary embodiment of a compound kicker 203 of the present invention is herein described with reference to such a media picking mechanism, it is understood that the present invention is also applicable to other media picking mechanisms or other printing devices.

Figure 4A:
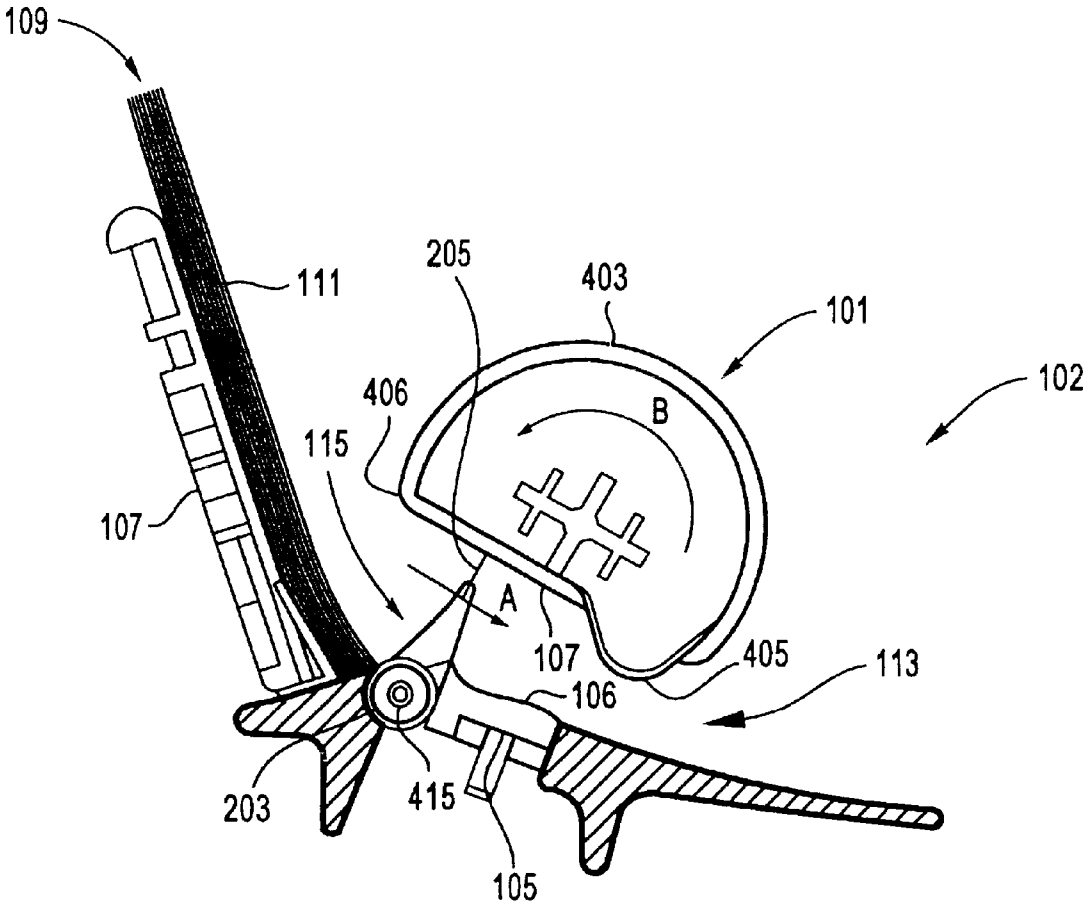
FIGS. 4A–4F are side views illustrating different stages of a pick process in which the kicker of FIG. 2 is used.

In FIGS. 2 and 4A, a pair of pick rollers 101 is mounted on a rotatable pick roller shaft 409 for picking a top sheet 111 atop a stack of media 109 accommodated in an input tray 107 of the printer. Furthermore, the pick roller 101 advances the top sheet 111 in a media advancement direction as shown by arrow A in FIGS. 2 and 4A along a media path through the feed zone 113 in the printer for subsequently imprinting images on it. Due to the friction force between adjacent media sheets, several sheets next to the top sheet 117, 119, 123, 125 (see FIGS. 4C, 4E and 4F, hereinafter "next-to-top sheets") also leave the input tray 107 and follow the top sheet 111 into the feed zone 113. To avoid a multiple pick, a separator 105 with a separating surface 106 is mounted in the media path at the entrance 115 of the feed zone 113 approximately opposite the pick roller 101 for stopping further movement of at least a first several next-to-top sheets 117. Movements of the remaining part of the next-to-top sheets 119 are stopped by the printer structure 121 located in the media path and before the separator in the media advancement direction A. In addition, a motor (not shown) rotates the pick roller shaft 409 and consequently the pick rollers 101 through a gear train 403 mounted at an end of the pick roller shaft 409.

The pick roller has a "D" profile that can be divided into two portions 403, 407 by an activating point 406 and a turning point 405 as shown in FIG. 4A. Basically, the curved portion 403 that has an arc profile starts from the turning point 405 in a counterclockwise direction as shown by arrow B in FIG. 4A and ends at the activating point 406. The flat portion 407 that has a straight-line profile starts from the turning point 405 in the clockwise direction and ends at the activating point 406.

The next-to-top sheets that have moved out of the input tray 107 and stopped somewhere in the feed zone are supposed to be cleared from the feed zone before the next pick process starts. For this purpose, a pair of compound kickers 203 according to an exemplary embodiment of the invention are provided for kicking the next-to-top sheets back to the input tray during a pick process. Each compound kicker 203 is mounted on a rotatable kicker shaft 415 opposite the pick roller 101 but displaced by a distance in a horizontal direction in which the kicker shaft extends. Furthermore, the kickers 203 are positioned in the media path adjacent to an edge of the input tray 107 and before the separator 105 in the media advancement direction such that the next-to-top sheets do not stay in contact with the separator after the kicking process. In addition, the kicker shaft 415 is biased by a spring (not shown) to keep the compound kickers in a kicking position, in which the kickers 203 project substantially perpendicular to the media advancement direction A. In FIG. 2, the kickers can be activated by a kicker cam 411 mounted on the pick roller shaft 409, and the kicker cam 411 has a profile similar to the pick roller 101 but is oriented at a slightly different angle. In this way, as the pick process just starts but before the pick roller starts picking the top sheet, the kicker cam 411 pressed down a lever portion 417 mounted at an end of the kicker shaft 415 to activate the kickers 203.

Figure 3:
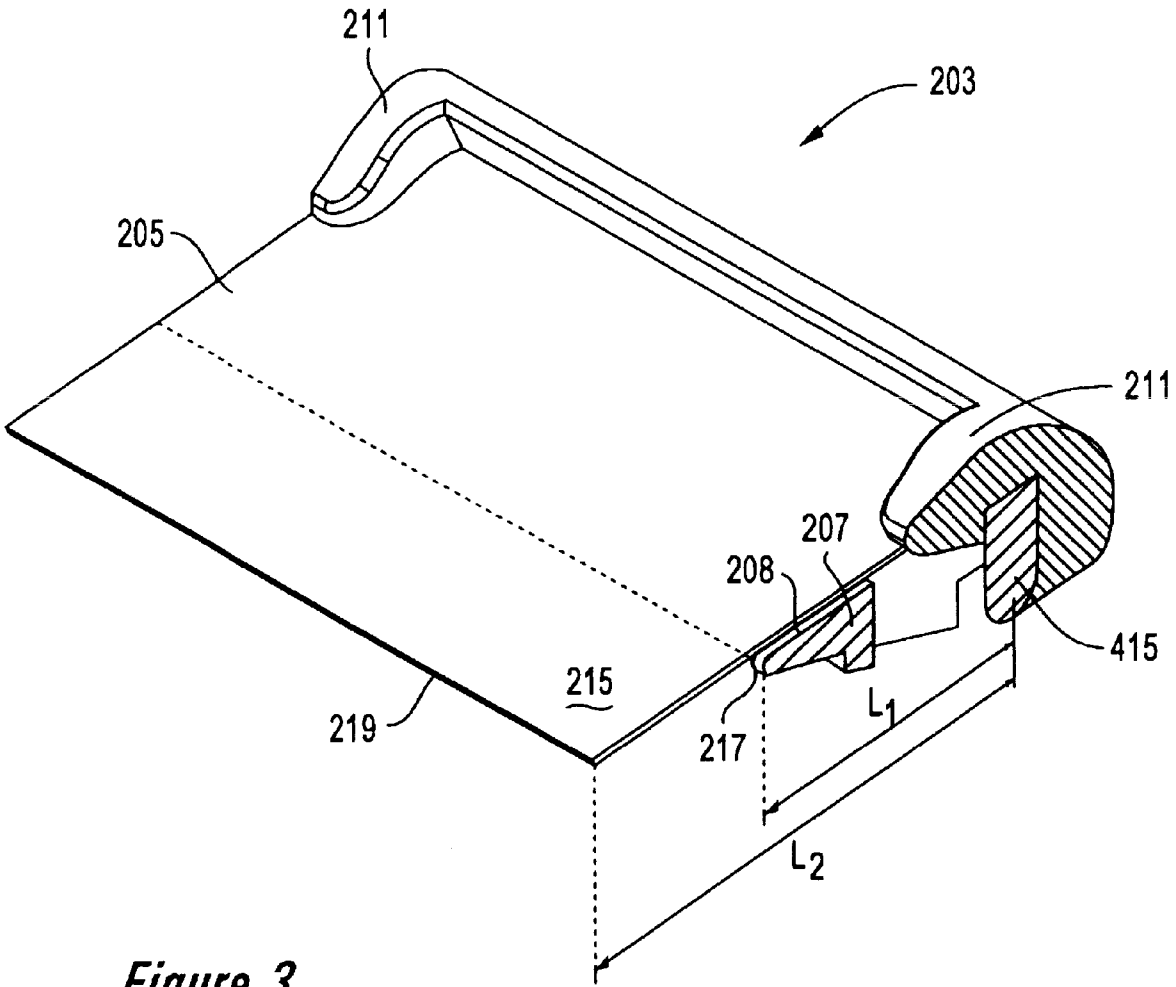
FIG. 3 is a perspective view of a compound kicker according to an exemplary embodiment of the invention.

FIG. 3 shows the compound kicker 203 according to an exemplary embodiment of the invention that can be used in the media picking mechanism of FIG. 2 as well as other media picking mechanisms or other printing devices. In the exemplary embodiment, the compound kicker 203 basically has a thin, flexible top part 205 in a flat plate shape and a rigid base part 207 in a shape similar to the conventional kicker 103 but with a reduced length. Both parts extend in the same direction perpendicular to the kicker shaft 415 in the exemplary embodiment. Furthermore, a plane surface 208 of the base portion 207 allows the top part 205 to be attached thereon. A pair of projections 211 made of the same material as the base part 207 and mounted to the base part 207 restrict the top part 205 to be in contact with the base part. Alternatively, adhesive materials can be applied between the top part 205 and the base part 207 for fastening them together. In addition, in the exemplary embodiment, the base part 207 is molded together with the kicker shaft 415 so that the kicker 203 can also rotate in the printer.

As shown in FIG. 3, in the current application, the length of the base part L1 is defined as a distance between a center of the kicker shaft and an end 217 of the base part, while the length of the top part L2 is defined as a distance between the center of the kicker shaft and an end 219 of the top part.

In the exemplary embodiment, the length of the base part 207 is designed to be approximately the same as the distance between the kicker shaft 415 and the mid point of the separator 105 in the media advancement direction. The length of the base part 207 is designed to not interfere with the top sheet 111 being fed through the print zone 113 during the kicking process. Furthermore, the length of the base part 207 is designed so that it can catch a main stack 215 of the next-to-top sheets as shown in FIG. 4D. The main stack 215 of the next-to-top sheets basically includes the next-to-top sheets 119 stopped by the printer structure 121. The main stack 215 can also include some next-to-top sheets stopped by the separator 105.

On the other hand, the length of the top part 205 is designed to be long enough to catch the next-to-top sheets that are stopped by the separator but not caught by the base part 207 in the kicking process. In the exemplary embodiment, the length of the top part 205 is designed to be approximately the same as a distance between the kicker shaft 415 and the end of the separator away from the kicker shaft 415 in the media advancement direction A. Note all the next-to-top sheets are supposed to stop before a contact point of the picker roller with the separating surface, and the contact point is roughly at the middle of the separating surface. Thus, the length of the top part 205 covers a further distance than any next-to-top sheets are expected to travel during a pick process. Given the length of the base part and the top part, it is noted that the top part of the compound kicker has a first portion 215 protruding outside the base part.

It is mentioned that the top part is flexible while the base part is relatively rigid. In the exemplary embodiment, the base part 207 has a relatively high bending rigidity, while the top part has a relatively low bending rigidity. Therefore, the base part can hardly be deformed, while the top part can relatively easily bend over even if only a relatively small amount of force is applied to its end. As a result, the base part provides a relatively large kicking force, while the top part provides a relatively small kicking force. In particular, in the exemplary embodiment, the top part is a polyester film for example the Mylar polyester film available from DuPont Company and is approximately as flexible as transparency materials, while the base part 207 is a molded polycarbonate block that is relatively rigid.

FIG. 4A illustrates the compound kicker 203 biased in the kicking position before the pick process starts and the pick roller 101 in a home position 102. When the pick roller is in its home position, its flat portion 407 is approximately parallel to the separating surface 106 of the separator 105. It is also noted that the compound kicker 203 does not interfere with the pick roller 101 due to the horizontal offset.

Figure 4B:
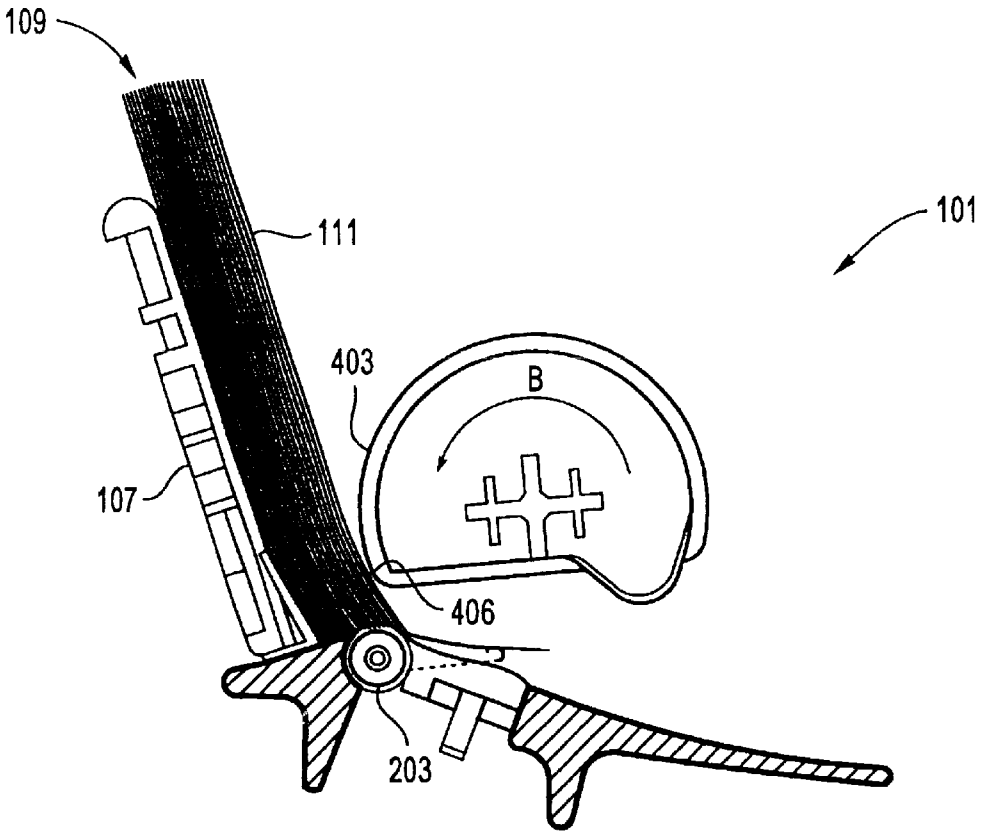

In FIG. 4B, as the pick process starts, the pick roller as well as the kicker cam rotates in the counterclockwise direction B in which the pick roller rotates toward the media stack 109 for picking and advancing the top sheet 111. Before the activating point 406 of the pick roller has reached the top sheet 11, the compound kicker 203 is activated by the kicker cam 411 and rotates toward a feed position, in which the kicker 203 extends in a direction substantially parallel to the separating surface of the separator. When the activating point 406 contacts the top sheet 111, the pick roller starts picking the top sheet and advancing the top sheet 111 forward in the media advancement direction. In addition, the friction forces between adjacent sheets start drawing several next-to-top sheets out of the input tray 107.

Figure 4C:
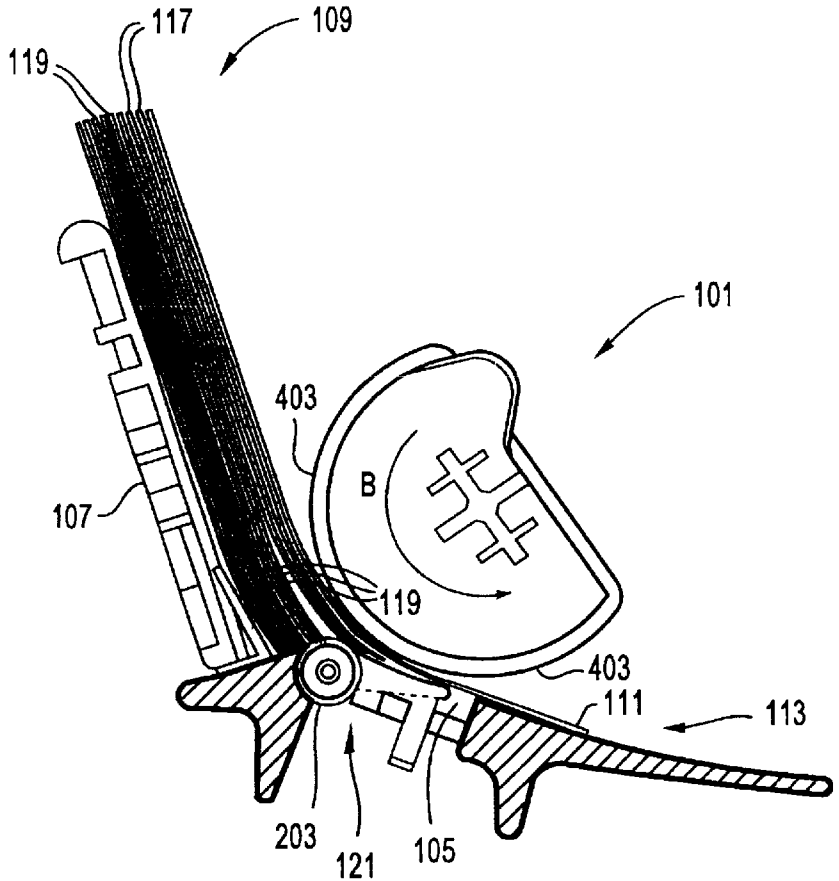
Figure 4D:
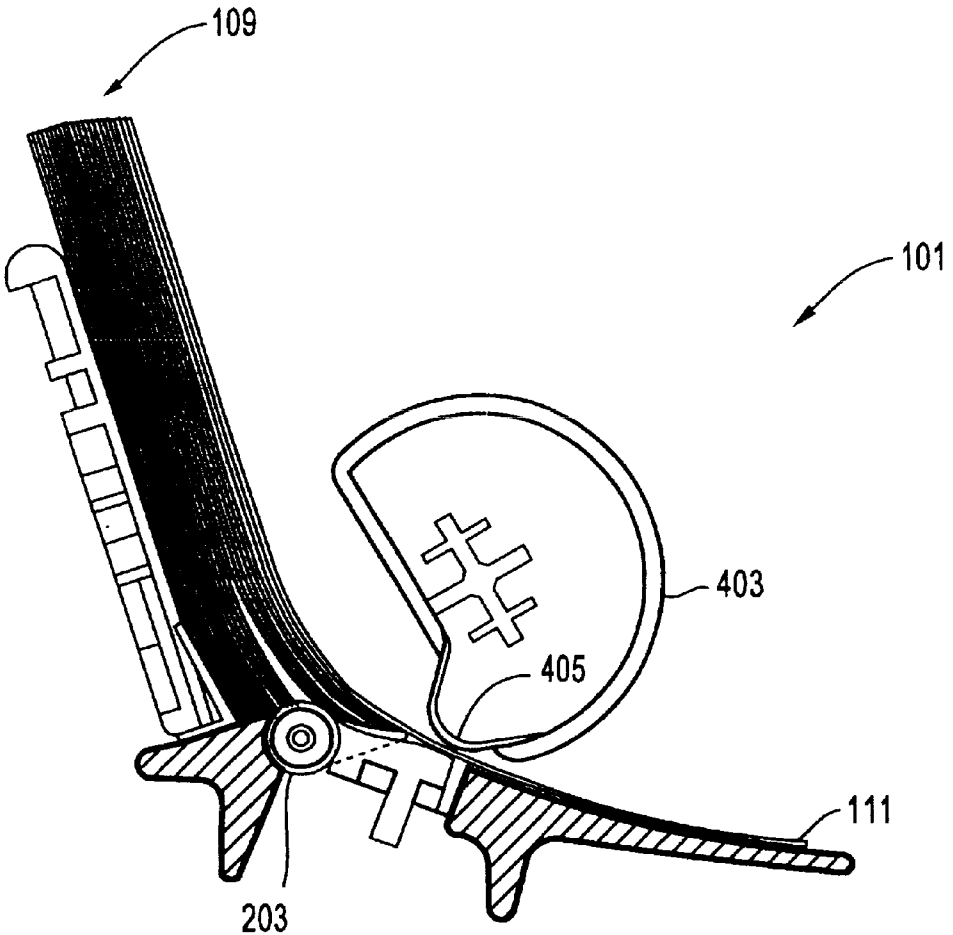

In FIG. 4C, as the pick roller 101 further rotates in the counterclockwise direction B, the top sheet 111 is advanced into the feed zone 113, followed by the next-to-top sheets. As the next-to-top sheets further move on in the pick process, first several next-to-top sheets 117 just underneath the top sheet are stopped by the separator 105. Another portion of the next-to-top sheets 119, which lies under the first several next-to-top sheets 117, is stopped by part of the printer structure 121 located in the media path before the separator 105 in the media advancement direction. The compound kicker 203 is further pressed down to its feed position by the kicker cam 411 (see FIG. 2) until it is fully depressed in the media path as shown in FIG. 4C.

In FIGS. 2 and 4D, the turning point 405 has just passed the compound kicker 203. The kicker cam 411, which has a profile similar to the pick roller 101, releases the lever 417 on the kick shaft 415, and the kicker 203 starts rotating back to its kicking position due to the biasing force provided by the spring (not shown). Furthermore, rotation of the kicker back to the kicking position will kick the next-to-top sheets back to the input tray 107 as further discussed with reference to FIGS. 4E and 4F.

It is understood that typically at this stage, the top sheet 111 has reached another feed roller (not shown) in the printer. This feed roller further advances the top sheet to a print zone (not shown) for imprinting images on it.

Figure 4E:
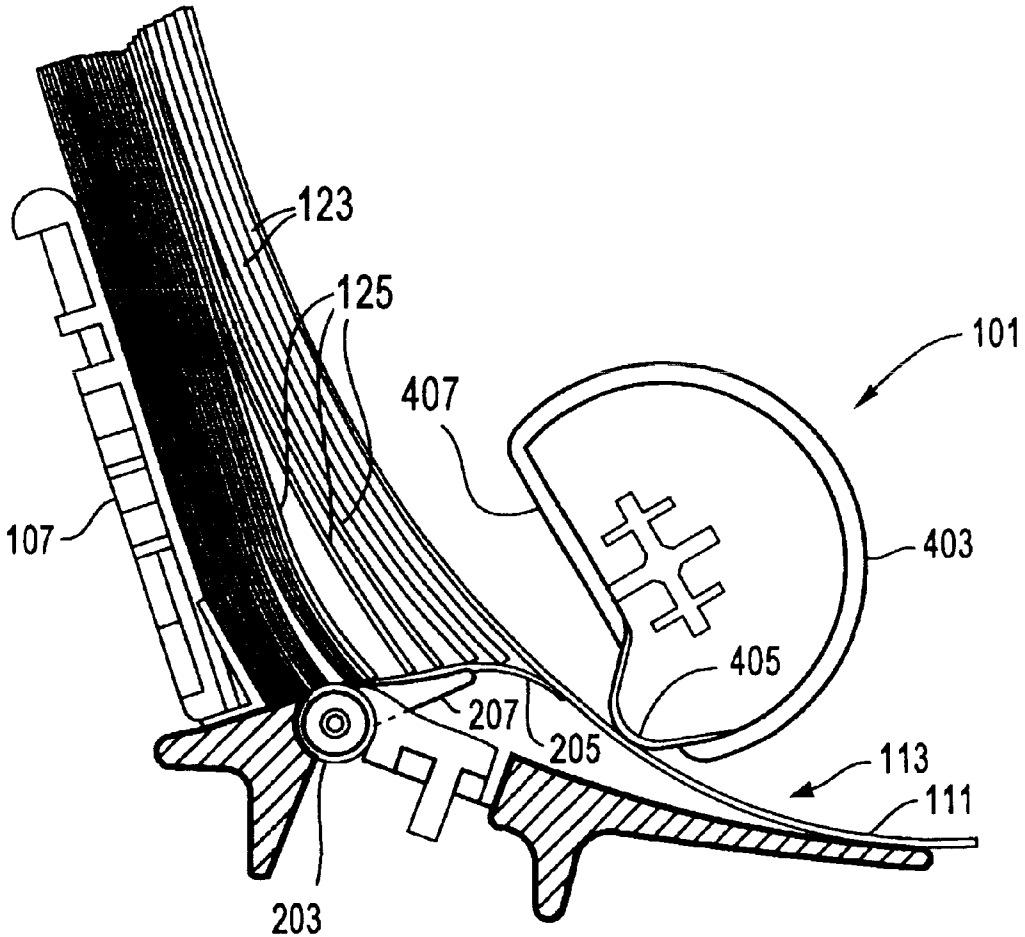

In FIG. 4E, the turning point 405 has passed the compound kicker 203, and the flat portion 407 of the pick roller now approximately faces the kicker 203. The flat portion 407 of the pick roller 101 now leaves a space between the compound kicker 203 and the pick roller as well as the top sheet 111. Without the limitation applied by the curved potion 403 of the pick roller 101, the compound kicker 203 is free to rotate back to its kicking position.

Figure 1:
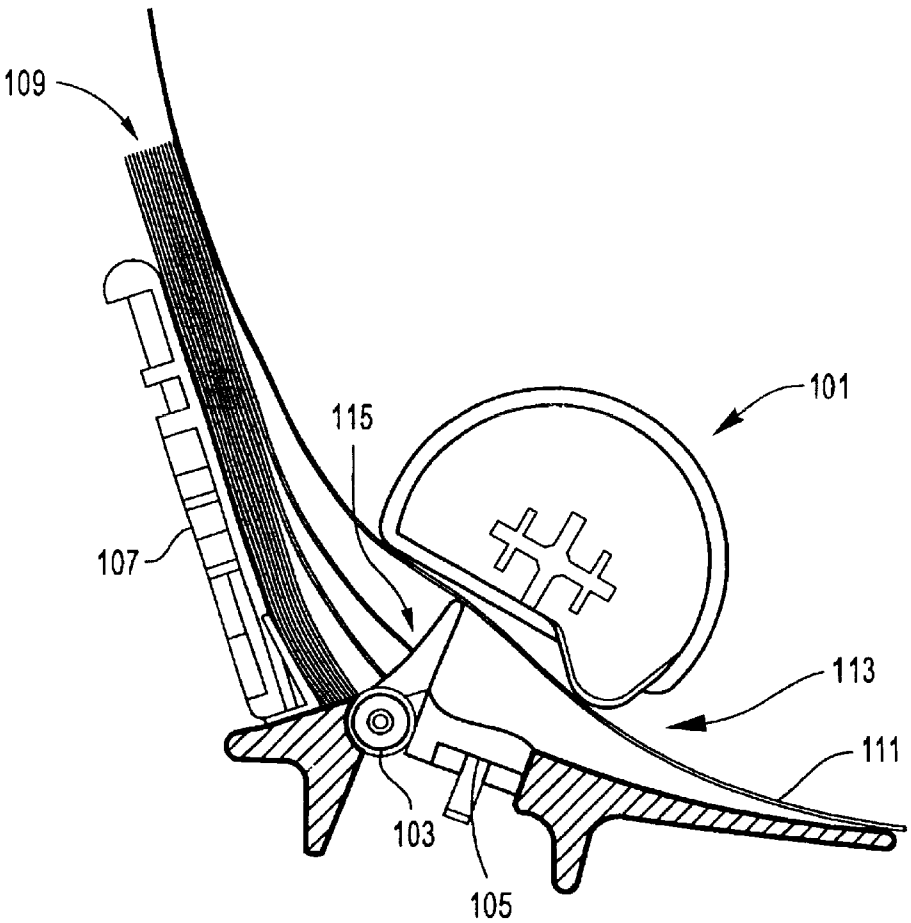
Figure 1 (PRIOR ART)
FIG. 1 is a side view illustrating that a conventional kicker in a prior art interferes with a top sheet being fed through a feed zone by a pick roller.

As discussed before, the length of base part 207 is designed to not interfere with the top sheet 111, which is being fed through the feed zone 113 when the compound kicker 203 is rotating back to the kicking position. However, the top part 205, specifically the first portion 215 that protrudes outside the base part, is designed long enough to meet the top sheet 111. Since the top part 205 is made of flexible material, the first portion 215 is bent by the top sheet 111 from the time when it comes into contact with the top sheet 111 and provides a relatively small kicking force. In this way, the interference between the top sheet 111 and the compound kicker 203 and consequently the stress on the top sheet applied by the kicker are reduced as compared to the conventional kicker 103 of FIG. 1.

Furthermore, as shown in FIG. 4E, the rigid base part 207 of the compound kicker 203 kicks the main stack 125 of the next-to-top sheets through a portion of the top part thereabove. It is understood that the main stack of the next-to-top sheets can be relatively thick and thus requires a relatively large kicking force. The rigidity of the base part 207 accordingly allows the compound kicker 203 to provide the necessary kicking force for kicking the heavy main stack back to the input tray 107. In this way, the effectiveness of the kicking operation is maintained.

FIG. 4E also shows the first portion 215 of the top part 205 of the compound kicker 203 in contact with several next-to-top sheets 123 between the top sheet 111 and the main stack 125. These several next-to-top sheets 123 are to be kicked back to the input tray 107 by the first portion 215 of the top part 205.

Figure 4F:
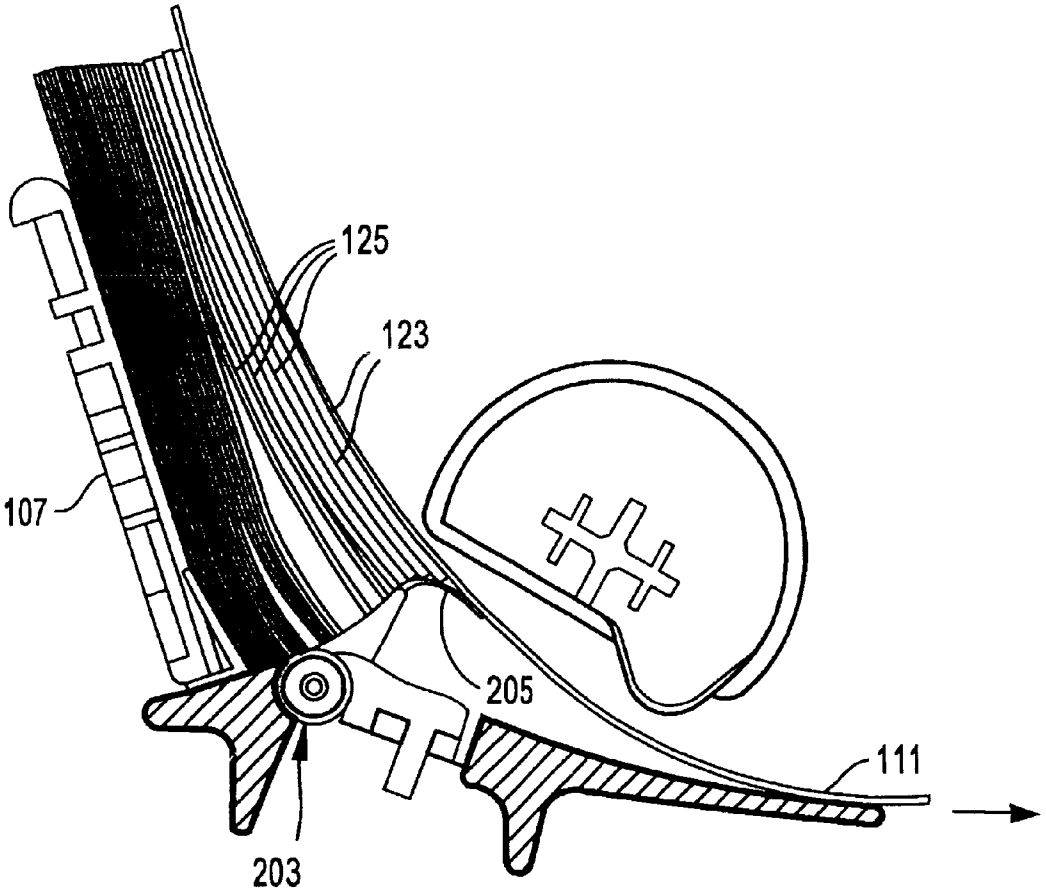

In FIG. 4F, the compound kicker 203 has reached its kicking position, with the main stack 215 kicked back to the input tray 107. Note that the several next-to-top sheets 123 kicked by the first portion of the top part during the kicking process may still cling to the top part 205. This is because that the top part of the kicker is still bent over by the top sheet 111 that is now being fed by the feed roller (not shown) into the print zone (not shown). When the top sheet 111 has fully passed through the feed zone, the top part 205 bounces back to its kicking position due to its own resilient force and then kicks the several next-to-top sheets 123 back to the input tray (not shown). In addition, since only a small amount of kicking force is needed for kicking back merely one or two sheets, kicking the several next-to-top sheets 123 can be easily done by the flexible top part of the compound kicker.

Furthermore, when the pick roller 101 reaches its home position as shown in FIG. 4A, the pick roller stops rotating, and the top sheet 111 is further advanced by the feed roller instead. The pick roller 101 stays in its home position until next pick process starts.

Alternatives can be made to the preceding embodiment. For example, instead of overlying atop the base part, the top part can be simply a portion that protrudes outside the base part, just like the first portion 215 alone. Adhesive materials or other mechanism are needed to fasten the top part and the base part together.

What is claimed is:

1. A kicker in a printing device mounted adjacent an entrance of a feed zone where a pick roller is located for picking a top sheet from an input tray in a pick process, wherein a plurality of next-to-top sheets next to the top sheet move out of the input tray and stop approximately at said entrance during the pick process, the kicker comprising:

a rigid base part for kicking a first portion of the next-to-top sheets back to the input tray; and a flexible top part attached to the base part and extending out of an end of the base part for kicking a second portion of the next-to-top sheets located between said first portion and said top sheet back to the input tray.

2. The kicker of claim 1, wherein the base part has a higher bending rigidity than the top part.

3. The kicker of claim 1, wherein the top part bends over when it meets the top sheet during the kicking process.

4. The kicker of claim 1, wherein the base part has a plane surface, and wherein the top part rests atop the plane surface.

5. A media handling system in a printing device, comprising:

a pick roller for picking a top sheet from an input tray toward a print zone during a pick process, wherein a plurality of next-to-top sheets next to the top sheet are drawn out of the input tray and stop approximately at an entrance of the print zone during the pick process; and a kicker mounted adjacent the pick roller, including a rigid base part for kicking a first portion of the next-to-top sheets back to the input tray, and a flexible top part attached to the base part and extending out of an end of the base part for kicking a second portion of the next-to-top sheets located between said first portion and said top sheet back to the input tray.

6. A method for kicking a plurality of next-to-top sheets back to an input tray in a printing device, wherein the next-to-top sheets move out of the input tray and stop approximately at an entrance of a feed zone during a pick process, the method comprising providing a kicker having a relatively rigid base part and a flexible top part attached to the base part;

kicking a first portion of the next-to-top sheets back to the input tray by using the base part of the kicker; and kicking a second portion of the next-to-top sheets back to the input tray by using the top part of the kicker.

7. The method of claim 6, wherein the step of kicking the second portion includes holding the second portion of next-to-top sheets for a period until a trailing edge of a top sheet atop the next-to-top sheets has fully passed the kicker during the pick process.

* * * * *